US009721775B2

(12) United States Patent
Brown

(10) Patent No.: US 9,721,775 B2
(45) Date of Patent: Aug. 1, 2017

(54) CHARGING PLATE FOR ENHANCING MULTIPLY CHARGED IONS BY LASER DESORPTION

(71) Applicant: Micromass UK Limited, Wilmslow (GB)

(72) Inventor: Jeffery Mark Brown, Hyde (GB)

(73) Assignee: Micromass UK Limited, Wilmslow (GB)

( * ) Notice: Subject to any disclaimer, the term of this patent is extended or adjusted under 35 U.S.C. 154(b) by 28 days.

(21) Appl. No.: 14/772,476

(22) PCT Filed: Mar. 5, 2014

(86) PCT No.: PCT/GB2014/050640

§ 371 (c)(1),
(2) Date: Sep. 3, 2015

(87) PCT Pub. No.: WO2014/135864

PCT Pub. Date: Sep. 12, 2014

(65) Prior Publication Data

US 2016/0020079 A1 Jan. 21, 2016

(30) Foreign Application Priority Data

Mar. 5, 2013 (EP) ..... 13157767
Mar. 5, 2013 (GB) ..... 1303922.7

(51) Int. Cl.
*B01F 13/00* (2006.01)
*H01J 49/04* (2006.01)
*H01J 49/06* (2006.01)

(52) U.S. Cl.
CPC ..... *H01J 49/0418* (2013.01); *H01J 49/068* (2013.01)

(58) Field of Classification Search
CPC .. H01J 49/0418; H01J 49/0431; H01J 49/165; G09G 3/00; G09G 3/006; G09G 3/348; B01F 13/0071; B01F 13/0076; B01F 13/0084; B01F 11/0071; B01F 15/0404; G01N 27/44791; G01N 1/38; G01N 27/3271; G01N 27/3277; G01N 27/447; G01N 30/6095; G01N 30/7233
USPC ..... 204/600, 450, 400, 403.01, 411, 412, 204/451, 547, 601, 643, 660, 663, 666; 205/775, 777.5; 250/288
See application file for complete search history.

(56) References Cited

U.S. PATENT DOCUMENTS 3,769,624 A * 10/1973 Lee ..... B41J 2/075 347/76
5,260,571 A 11/1993 Cottrell et al.
5,705,813 A * 1/1998 Apffel ..... B01L 3/5027 250/288
5,969,353 A 10/1999 Hsieh
(Continued)

FOREIGN PATENT DOCUMENTS

WO 2011/060369 5/2011

OTHER PUBLICATIONS

ARC-USA, "*Keypads Design Guide*", www.arcusainc.com.

*Primary Examiner* — David A Vanore
(74) *Attorney, Agent, or Firm* — Diederiks & Whitelaw, PLC

(57) ABSTRACT

A sample plate for an ion source is disclosed comprising a plurality of ionization regions, each ionization region comprising a first electrode and a second separate electrode separated by an insulator.

24 Claims, 1 Drawing Sheet

(56) References Cited

U.S. PATENT DOCUMENTS 6,464,866 B2 10/2002 Moon et al.
6,812,456 B2 11/2004 Andersson et al.
6,911,132 B2 * 6/2005 Pamula ..... B01F 11/0071 204/600
7,105,809 B2 9/2006 Wood et al.
7,454,988 B2 * 11/2008 Tan ..... G01N 1/4055 204/600
7,638,035 B2 * 12/2009 Sasaki ..... G01N 27/3277 204/400
7,655,902 B2 2/2010 Choi et al.
7,750,290 B2 7/2010 Fourrier et al.
7,767,069 B2 * 8/2010 Lee ..... B01L 3/502792 204/450
8,287,708 B2 * 10/2012 Fan ..... B01J 13/04 204/450
8,329,115 B2 * 12/2012 Han ..... B01L 3/50273 137/833
8,415,619 B2 4/2013 Goodlett et al.
8,653,832 B2 * 2/2014 Hadwen ..... G09G 3/00 204/600
8,853,621 B2 10/2014 Trimpin
8,899,730 B2 * 12/2014 Takemoto ..... B41J 2/055 347/57
8,980,198 B2 * 3/2015 Srinivasan ..... B01F 13/0071 422/503
9,011,662 B2 * 4/2015 Wang ..... B41J 2/14024 204/600
9,087,683 B2 * 7/2015 Girault ..... H01J 49/0031
9,128,014 B2 * 9/2015 Bhattacharya ..... B01F 13/0071
9,238,222 B2 * 1/2016 Delattre ..... B01L 3/502723
2006/0022130 A1 2/2006 Bousse et al.
2006/0194331 A1 * 8/2006 Pamula ..... B01F 13/0071 436/150
2007/0158192 A1 7/2007 Timperman et al.
2010/0101965 A1 * 4/2010 Sasaki ..... G01N 27/3271 205/775
2010/0323917 A1 12/2010 Vertes et al.
2011/0247938 A1 * 10/2011 Wang ..... B01L 3/502792 204/603
2012/0085903 A1 4/2012 Trimpin
2015/0008123 A1 * 1/2015 Cheng ..... H01G 11/32 204/450

* cited by examiner

CHARGING PLATE FOR ENHANCING MULTIPLY CHARGED IONS BY LASER DESORPTION

CROSS-REFERENCE TO RELATED APPLICATION

This application is the National Stage of International Application No. PCT/GB2014/050640, filed 5 Mar. 2014 which claims priority from and the benefit of United Kingdom patent application No. 1303922.7 filed on 5 Mar. 2013 and European patent application No. 13157767.8 filed 5 Mar. 2013. The entire contents of these applications are incorporated herein by reference.

BACKGROUND OF THE PRESENT INVENTION

The present invention relates to a sample plate for an ion source, an ion source, a mass spectrometer, a method of ionising a sample and a method of mass spectrometry.

Electrospray ionisation ("ESI") is known wherein charging of analyte ions occurs within the liquid phase prior to the spraying of charged droplets towards an inlet of a mass spectrometer. Evaporation of the droplets leads to the formation of multiply charged gas phase ions. The charge distribution approximately reflects the charges that were electrophoretically generated in the liquid phase.

Another method of ionisation is known and is referred to as Sonicspray ionisation ("SSI") which uses a high pressure nebuliser to produce droplets without there being a potential drop between the ion source and the inlet to the mass spectrometer. According to this approach both singly and multiply charged ions are generated either with or without a voltage being applied to the liquid phase. However, significantly more ions are generated when a voltage is applied to the sample liquid. The charge is believed to come from the statistical imbalance and distribution of charges prior to droplet disruption due to shear stress.

Matrix Assisted Laser Desorption Ionisation ("MALDI") is another known ionisation process and uses a solid crystalline matrix with analyte embedded within it. In the dried solid crystalline phase there is little, if any, charge mobility within the matrix. Singly charged species are typically dominant after analyte protonation. Multiply charged ions have been observed at low levels but the process of generating multiply charged ions by MALDI has not been fully understood or commercially exploited.

WO 2012/058248 and US 2012/0085903 disclose a method of ionisation known as Laserspray ionisation ("LSI"). Laserspray ionisation, like MALDI, uses a solid matrix. Although singly charged species are often generated, multiply charged ions are more prevalent when the desorbed particles are caused to collide with a heated vacuum transfer tube. Droplets then attain an energy component capable of shearing the charge separated particles (probably droplets) in a similar manner to Sonicspray. Charge mobility within the molten matrix droplet via a double layer formation effect may contribute to the charge states.

Matrix Assisted Inlet Ionization ("MAII") is similar to Laserspray but does not use a laser. Instead, heat is used to vaporize the matrix into vacuum or a mechanical disturbance causes the matrix to enter a heated transfer tube. Multiply charged ions can be generated. Liquid, crystal or particle fracturing has been given as a possible explanation for generating multiply charged ions in a similar manner to Laserspray.

Solvent Assisted Inlet Ionization ("SAII") is another ionisation method which produces multiply charged ions when droplets interact (and receive energy) from heated surfaces. The ion signal is orders of magnitude higher when the liquid has been pre-charged using a voltage (like Sonicspray). The charges within the liquid droplets are mobile and become stratified and when shattered by collisions produce highly charged analyte ions.

US 2003/0066957 (Andersson) discloses a microfluidic device in the form of a disc. FIG. 4*e* shows a cross-sectional view of an Energy Desorption Ionisation ("EDI") area.

U.S. Pat. No. 5,260,571 (Cottrell) discloses an arrangement with reference to FIG. 2 wherein a mixture of proteins is separated electrophorectically in a slab 21 of polyacrylamide gel. The gel 21 is placed in a blotting tank 22 having a bottom electrode 24. One or more targets 25 precoated with a substrate material are placed face down on the upper surface of the gel 21. A potential difference of a few tens of volts is applied between the bottom electrode 24 and the conductive targets 25 which induces proteins to migrate from the gel 21 towards the targets 25 where they are bound by the substrate material.

US 2010/0323917 (Vertes) discloses the production and use of semiconducting nanopost arrays made by nanofabrication.

US 2004/0094705 (Wood) discloses a microstructured polymeric substrate.

US 2008/0245961 (Choi) discloses a nanowire-assisted method for mass spectrometric analysis of a specimen.

US 2008/0156983 (Fourrier) discloses an integrated system for microfluidic analysis. FIGS. 1-4 disclose an arrangement for moving drops on a track. With reference to FIG. 5 by successively applying potential differences between electrodes 2*a*-2*h* and line 5 it is possible to move a drop 14 and to immobilise the drop on a pad 12*a*-12*f*.

GB 2306644 (Apffel) discloses a liquid handling system for a MALDI-Time of Flight mass spectrometer.

It is desired to provide an improved ionisation method.

SUMMARY OF THE PRESENT INVENTION

According to an aspect of the present invention there is provided a sample plate for an ion source comprising:

one or more ionisation regions, each ionisation region comprising a first electrode and a second separate electrode; and a voltage device for applying a voltage between the first and second electrodes in order to maintain an electric field between the first and second electrodes;

wherein the sample plate is arranged and adapted so that, in use, one or more droplets are deposited in an ionisation region so as to extend between the first electrode and the second electrode so that an electrical pathway is provided between the first electrode and the second electrode via the one or more droplets.

US 2003/0066957 (Andersson) does not disclose an arrangement wherein droplets are deposited so as to extend between two electrodes wherein an electric field is maintained between the two electrodes.

US 2008/0156983 (Fourrier) discloses a method of moving a drop and immobilising the drop on a pad. US 2008/0156983 does not disclose providing an ionisation region comprising a first electrode and a second separate electrode or maintaining an electric field between the first and second electrodes which form the ionisation region.

According to the preferred embodiment the droplets deposited on the ionisation region remain stationary when the voltage device applies a voltage between the first and second electrodes i.e. the purpose of the applied voltage according to the preferred embodiment is to improve the ionisation of the droplets rather than to move the droplets.

The present invention relates to a sample plate for an ion source which incorporates electrodes for applying an electric field directly into a sample liquid in order to cause multiple charging of analyte species prior to desorption and ionization.

According to an embodiment the desorbed liquid droplets may be directed through an energy imparting transfer device for enhancing the generation and detection of multiply charged ion signals.

The present invention seeks to solve the problem of generating multiply charged MALDI ions since an ionisation method like Laserspray requires a high fluence and is not very sensitive or reproducible.

According to an aspect of the present invention there is provided a sample plate for an ion source comprising:

one or more ionisation regions, each ionisation region comprising a first electrode and a second separate electrode.

The first electrode and the second electrode are preferably substantially co-planar.

Each first electrode is preferably separated from the second electrode by an insulator.

The sample plate preferably comprises an array of ionisation regions.

The sample plate preferably comprises a voltage device for applying a DC voltage between the first and second electrodes in order to maintain an electric field between the first and second electrodes.

The sample plate preferably comprises a voltage device for applying an AC voltage between the first and second electrodes in order to maintain an electric field between the first and second electrodes.

The sample plate is preferably arranged so that when one or more droplets are deposited in an ionisation region and extend between the first electrode and the second electrode then an electrical pathway is provided between the first electrode and the second electrode via the one or more droplets.

At least some of the first electrodes and/or the second electrodes preferably comprise a needle or other projection which is preferably arranged and adapted to secure, in use, a biological or other sample to the sample plate.

According to an aspect of the present invention there is provided an ion source comprising a sample plate as described above.

The ion source preferably further comprises a laser for ionising and/or desorbing analyte deposited upon the sample plate.

The ion source preferably comprises a Matrix Assisted Laser Desorption Ionisation ("MALDI") ion source.

According to another embodiment the ion source may comprise a Desorption Electrospray Ionisation ("DESI") ion source, a Laser Ablation Electrospray Ionisation ("LAESI") ion source, a Solvent Assisted Inlet Ionisation ("SAII") ion source, a Matrix Assisted Inlet Ionisation ("MAII") ion source or a Laserspray Ionisation ("LSI") ion source.

The ion source preferably further comprises a sonic, electrical, spark or mechanical device for ionising and/or desorbing analyte deposited upon the sample plate.

According to an aspect of the present invention there is provided a mass spectrometer comprising an ion source as described above.

The mass spectrometer preferably further comprises:

an ion inlet orifice; and a device for maintaining an electric field between the sample plate and the ion inlet orifice.

The mass spectrometer preferably further comprises an energy imparting device arranged between the sample plate and the ion inlet orifice.

The energy imparting device preferably comprises a heated inlet transfer tube or other heated device for increasing the generation of multiply charged ions.

According to an aspect of the present invention there is provided a method of ionising a sample comprising:

providing a sample plate comprising one or more ionisation regions, each ionisation region comprising a first electrode and a second separate electrode; and applying or maintaining an electric field between the first and second electrodes.

The method preferably further comprises:

depositing one or more droplets in each ionisation region so that the one or more droplets extend between the first electrode and the second electrode so that an electrical pathway is provided between the first electrode and the second electrode via the one or more droplets.

According to an aspect of the present invention there is provided a method of mass spectrometry comprising a method as described above.

According to another aspect of the present invention there is provided a method of ionising a sample comprising:

providing a sample plate comprising one or more ionisation regions, each ionisation region comprising a first electrode and a second separate electrode;

applying a voltage between the first and second electrodes in order to maintain an electric field between the first and second electrodes; and depositing one or more droplets in an ionisation region so as to extend between the first electrode and the second electrode so that an electrical pathway is provided between the first electrode and the second electrode via the one or more droplets.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi)>500 V peak to peak.

The AC or RF voltage preferably has a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv)>10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i)<0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix)>1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1:
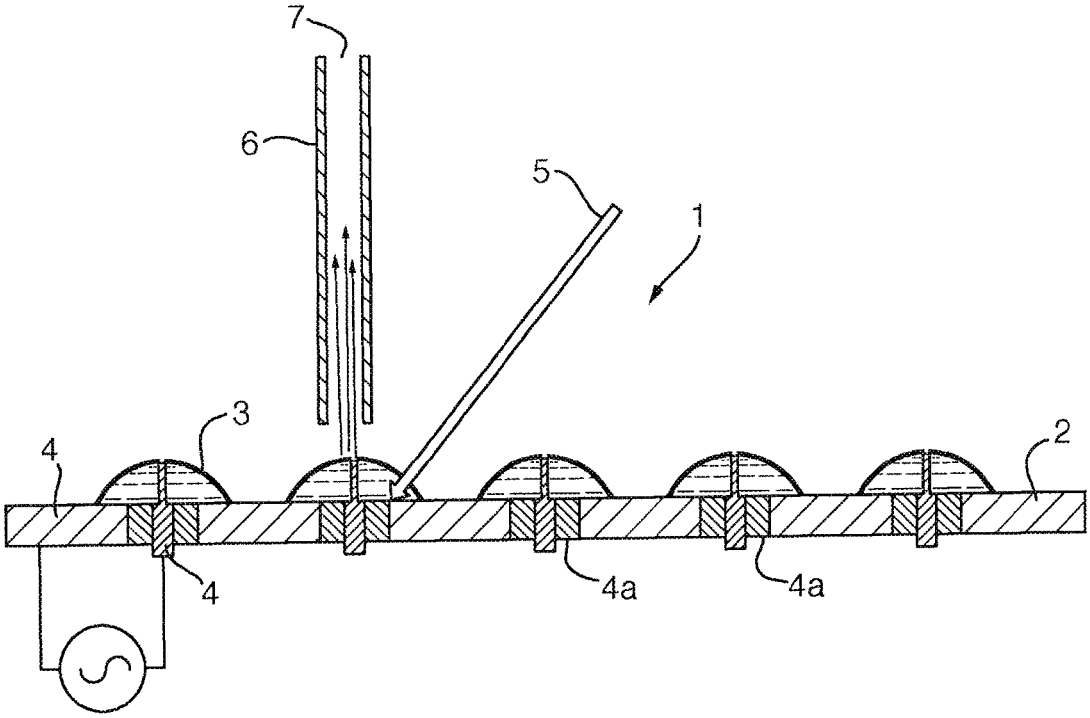
FIG. 1 shows an electro-MALDI sample plate according to an embodiment of the present invention.

According to a preferred embodiment of the present invention an electro-MALDI sample plate 1 is provided for enhancing the generation of multiply charged ions. A sample plate 1 according to a preferred embodiment is shown in FIG. 1. Droplets of liquid matrix 3 are preferably provided on a target plate 2. Two electrodes 4 per droplet are preferably arranged so as to apply an electric field to or maintain an electric field within the liquid droplet 3. The electrodes 4 are preferably separated by an insulator 4*a*. The electrodes 4 and the insulator 4*a* are preferably co-planar. The electric field preferably charges the analyte and electrolytes in the matrix solution 3 prior to laser desorption by a laser beam from a laser 5.

The liquid matrix 3 may or may not contain conventional MALDI matrices.

Upon desorption, droplets of charged liquid retain or attain a high charge imbalance. The droplets are preferably directed towards an inlet of a mass spectrometer 7 and preferably collide with an energy imparting device such as a heated vacuum inlet transfer tube 6 prior to analysis in the mass spectrometer 7. The inlet 6 is preferably arranged to cause shearing of the desorbed droplets in a similar manner to Laserspray and Sonicspray. The evaporation/shearing and desolvation of droplets within the transfer tube 6 significantly increases the number of multiply charged analyte ions which are observed.

According to an alternative embodiment the pre-charging sample plate 2 may be utilised in conjunction with other surface ambient ionisation techniques using liquids such as Desorption Electrospray Ionisation ("DESI") and Laser Ablation Electrospray ionisation ("LAESI").

According to an alternative embodiment the droplet desorption may be caused by means other than a laser e.g. by using sonic, electrical, spark or mechanical energy.

The target plate 2 does not necessarily need to be maintained at atmospheric pressure and according to less preferred embodiments the target plate 2 may be maintained at an intermediate pressure or in a low pressure regime.

According to an embodiment a supplemental electric field may be provided between the target plate 2 and the inlet of the mass spectrometer 7 in order to help transfer ions and enhance ionisation.

According to another embodiment elongated channel structure electrodes instead of circular droplets of liquid may be used in order to provide on surface electrophoresis.

Figure 2:
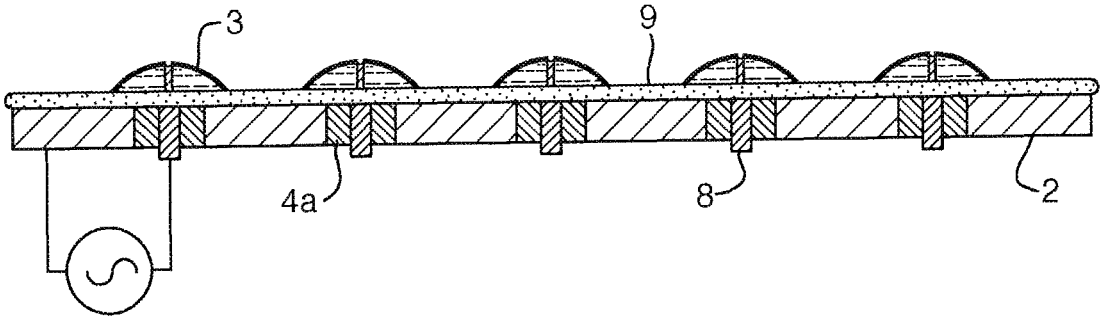
FIG. 2 shows a preferred sample plate for utilisation in MS imaging comprising needle shaped electrodes which assist in securing a sample to the sample plate.

The present invention may also be applied to the field of MS imaging ("MSI"). The target plate 2 may comprise an array of needle electrodes 8 that hold, pin or otherwise secure a tissue surface or biological sample 9 on to the surface of the sample or target plate 2. A liquid matrix 3 is then preferably applied on top of the tissue 9 as shown in FIG. 2. The liquid matrix 3 may include chemicals which draw out analytes from the tissue 9 into the liquid matrix solution ready for ionisation. Such an arrangement is particularly advantageous since current imaging methods are more effective when analyte species are close to the surface of the tissue 9.

According to an embodiment an additional burst of high voltage may be applied to the electrodes 8 in a timed sequence so as to Electrospray each liquid droplet towards the inlet of the mass spectrometer 7 for predetermined sample positions.

Although the present invention has been described with reference to preferred embodiments, it will be understood by those skilled in the art that various changes in form and detail may be made without departing from the scope of the invention as set forth in the accompanying claims.

The invention claimed is:

1. A sample plate comprising:

one or more ionisation regions, each ionisation region comprising a first electrode and a second separate electrode; and a voltage device for applying a voltage between said first and second electrodes in order to maintain an electric field between said first and second electrodes;

wherein said sample plate is arranged and adapted so that, in use, one or more droplets are deposited in an ionisation region so as to extend between said first electrode and said second electrode so that an electrical pathway is provided between said first electrode and said second electrode via said one or more droplets.

2. A sample plate as claimed in claim 1, wherein said first electrode and said second electrode are substantially co-planar.

3. A sample plate as claimed in claim 1, wherein each said first electrode is separated from said second electrode by an insulator.

4. A sample plate as claimed in claim 3, wherein said first electrode, said second electrode and said insulator are substantially co-planar.

5. A sample plate as claimed in claim 1, wherein said sample plate comprises an array of ionisation regions.

6. A sample plate as claimed in claim 1, wherein said voltage device is arranged and adapted to apply a DC voltage between said first and second electrodes.

7. A sample plate as claimed in claim 1, wherein said voltage device is arranged and adapted to apply an AC voltage between said first and second electrodes.

8. A sample plate as claimed in claim 1, wherein at least some of said first electrodes or said second electrodes comprise a needle or other projection.

9. A sample plate as claimed in claim 8, wherein said needle or other projection is arranged and adapted to secure, in use, a biological or other sample to said sample plate.

10. An ion source comprising:

a sample plate including:

one or more ionisation regions, each ionisation region comprising a first electrode and a second separate electrode; and a voltage device for applying a voltage between said first and second electrodes in order to maintain an electric field between said first and second electrodes, wherein said sample plate is arranged and adapted so that, in use, one or more droplets are deposited in an ionisation region so as to extend between said first electrode and said second electrode so that an electrical pathway is provided between said first electrode and said second electrode via said one or more droplets.

11. An ion source as claimed in claim 10, further comprising a laser for ionising or desorbing analyte deposited upon said sample plate.

12. An ion source as claimed in claim 10, wherein said ion source comprises a Matrix Assisted Laser Desorption Ionisation ("MALDI") ion source.

13. An ion source as claimed in claim 10, wherein said ion source comprises a Desorption Electrospray Ionisation ("DESI") ion source.

14. An ion source as claimed in claim 10, wherein said ion source comprises a Laser Ablation Electrospray Ionisation ("LAESI") ion source.

15. An ion source as claimed in claim 10, wherein said ion source comprises a Solvent Assisted Inlet Ionisation ("SAII") ion source.

16. An ion source as claimed in claim 10, wherein said ion source comprises a Matrix Assisted Inlet Ionisation ("MAII") ion source.

17. An ion source as claimed in claim 10, wherein said ion source comprises a Laserspray Ionisation ("LSI") ion source.

18. An ion source as claimed in claim 10, further comprising a sonic, electrical, spark or mechanical device for ionising or desorbing analyte deposited upon said sample plate.

19. A mass spectrometer comprising:

an ion source including:

a sample plate having, one or more ionisation regions, each ionisation region comprising a first electrode and a second separate electrode; and a voltage device for applying a voltage between said first and second electrodes in order to maintain an electric field between said first and second electrodes, wherein said sample plate is arranged and adapted so that, in use, one or more droplets are deposited in an ionisation region so as to extend between said first electrode and said second electrode so that an electrical pathway is provided between said first electrode and said second electrode via said one or more droplets.

20. A mass spectrometer as claimed in claim 19, further comprising:

an ion inlet orifice; and a device for maintaining an electric field between said sample plate and said ion inlet orifice.

21. A mass spectrometer as claimed in claim 20, further comprising an energy imparting device arranged between said sample plate and said ion inlet orifice.

22. A mass spectrometer as claimed in claim 21, wherein said energy imparting device comprises a heated inlet transfer tube or other heated device for increasing the generation of multiply charged ions.

23. A method of ionising a sample comprising:

providing a sample plate comprising one or more ionisation regions, each ionisation region comprising a first electrode and a second separate electrode;

applying a voltage between said first and second electrodes in order to maintain an electric field between said first and second electrodes; and depositing one or more droplets in an ionisation region so as to extend between said first electrode and said second electrode so that an electrical pathway is provided between said first electrode and said second electrode via said one or more droplets.

24. A method of mass spectrometry comprising a method as claimed in claim 23.

* * * * *